US005887967A

United States Patent [19]

Chang

[11] Patent Number: 5,887,967

[45] Date of Patent: Mar. 30, 1999

[54] DECORATIVE LIGHT STRING WITH LED BULBS

[76] Inventor: Tai-Fu Chang, No. 2, Lane 94, Chien Chia Road, Hsinchu, Taiwan

[21] Appl. No.: 963,078

[22] Filed: Nov. 3, 1997

[51] Int. Cl.[6] ..... F21V 33/00

[52] U.S. Cl. ..... 362/226; 362/806; 439/619

[58] Field of Search ..... 362/226, 249, 362/252, 800, 806, 457; 439/619, 399.2, 375, 356

[56] References Cited

U.S. PATENT DOCUMENTS 5,709,457 1/1998 Hara ..... 362/226

*Primary Examiner*—Y My Quach

*Attorney, Agent, or Firm*—Rosenberg, Klein & Bilker

[57] ABSTRACT

The invention relates to an improved structure of a decorative light string, which includes an electrical wire to connect with many bulb assemblies for decorative lighting. The bulb assembly includes a light bulb holder with a dint to receive a LED bulb and a base with a dint to receive the holder together with the LED bulb under a corrective direction. By use of the invention, the light string lights without high heat and prevent from any accident of fire and damage.

1 Claim, 2 Drawing Sheets

DECORATIVE LIGHT STRING WITH LED BULBS

BACKGROUND OF THE INVENTION

Conventional decorative light string has been used for a long time which includes an electrical wire connecting with a plurality of light bulbs. The known bulbs are almost filament-bulbs (1), as shown in FIG. 1. These bulbs will be very hot after being used for a period of time. Therefore, the heat of the filament-bulbs is possible to burn something around them, that might hurt a user who carelessly contacts the bulbs or cause a terrible accident of fire.

OBJECT OF THE INVENTION

The main object of the invention is to provide an improved decorative light string with safe LED bulbs which will not occur heat and is capable of being safely used for a long time.

The detailed structure, features, and other advantages of this invention will become apparent from the following detailed description of a preferred embodiment when read with reference to the accompanying drawings.

DETAILED DESCRIPTION OF THE PREFERRED EMBODIMENT

Figure 1:
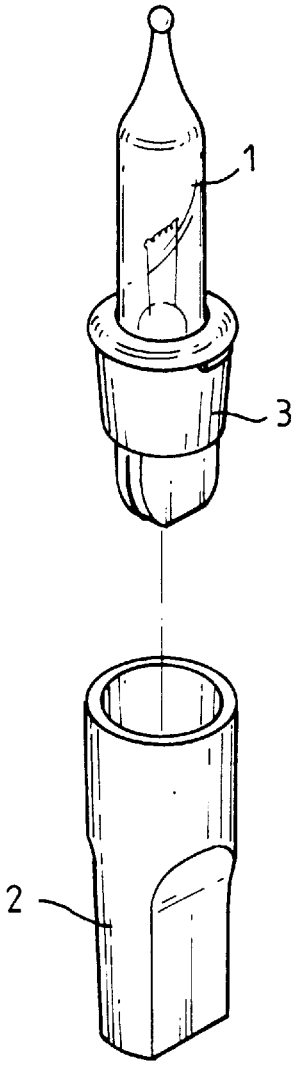
FIG. 1 PRIOR ART
FIG. 1 is a perspective view showing a prior art embodiment of a filament-bulb assembly of a light string.
Figure 2:
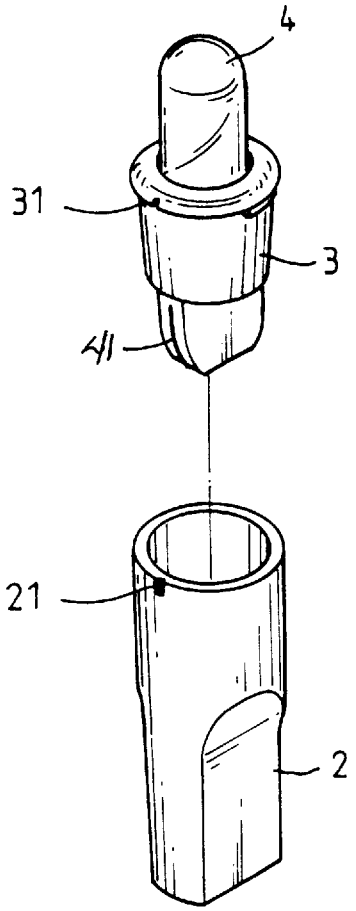
FIG. 2 is a perspective view showing a preferred embodiment of an improved LED bulb assembly according to this invention.

Referring to FIG. 2, it can be seen that the present invention includes a base (2), a light bulb holder (3), a LED bulb (4) having a pair of leads (41), wherein the base (2) is provided with a dint (21) at one side and the light bulb holder (3) is also provided a dint (31) at one side on its top. The LED bulb (4) is received in the holder (3) with one of the leads (41) aligned with the dint (31). The holder (3) accompanying with the LED bulb (4) is then engaged within the base (2) in a direction of the dint (31) of the holder (3) matching the dint (21) of the base (2). The corrective connection between the base (2) and the light bulb holder (3) is for the use of the LED bulb (4). By aligning the dints on base and the light bulb holder, it is convenient to complete an LED bulb assembly of the present invention.

It is to be understood that the light string of this invention includes a series of wire connecting with a plurality of LED bulbs which light without high heat. Users can hang this light string on any desired place and prevent from any accident or damage. Accordingly, the structure of the present invention makes obvious improvement and should be patentable.

I claim:

1. A light bulb assembly for a decorative light string, comprising (a) an LED lamp having a pair of leads, (b) a light bulb holder for receiving said LED lamp therein, said light bulb holder having a first dint on one side thereof in aligned relationship with one of said leads of said LED lamp, and (c) a base having a second dint formed on one side thereof for receiving said light bulb holder therein with said first dint disposed in aligned relationship with said second dint.

* * * * *